US011508535B2

(12) United States Patent
Mathae

(10) Patent No.: US 11,508,535 B2
(45) Date of Patent: Nov. 22, 2022

(54) SPRING UNIT AND A DIVERTER SWITCH

(71) Applicant: Hitachi Energy Switzerland AG, Baden (CH)

(72) Inventor: Jean Mathae, Ludvika (SE)

(73) Assignee: Hitachi Energy Switzerland AG, Baden (CH)

( * ) Notice: Subject to any disclaimer, the term of this patent is extended or adjusted under 35 U.S.C. 154(b) by 0 days.

(21) Appl. No.: 17/606,018

(22) PCT Filed: Nov. 22, 2019

(86) PCT No.: PCT/EP2019/082279
§ 371 (c)(1),
(2) Date: Oct. 23, 2021

(87) PCT Pub. No.: WO2020/216461
PCT Pub. Date: Oct. 29, 2020

(65) Prior Publication Data

US 2022/0148825 A1 May 12, 2022

(30) Foreign Application Priority Data

Apr. 23, 2019 (EP) ..... 19170682

(51) Int. Cl.
*H01H 9/00* (2006.01)
*H01F 21/12* (2006.01)

(52) U.S. Cl.
CPC ..... *H01H 9/0027* (2013.01); *H01F 21/12* (2013.01); *H01H 9/0016* (2013.01); *H01H 2235/01* (2013.01)

(58) Field of Classification Search
CPC ..... H01H 2009/00; H01H 2009/0005; H01H 2009/50; H01H 2009/525; H01H 21/00;
(Continued)

(56) References Cited

U.S. PATENT DOCUMENTS 3,811,022 A 5/1974 Guidosh
4,585,911 A * 4/1986 Has ..... F16H 33/00 200/425

(Continued)

FOREIGN PATENT DOCUMENTS

CA 2207562 A1 8/1998
CN 202839338 U 3/2013

(Continued)

OTHER PUBLICATIONS

International Search Report and Written Opinion of the International Searching Authority, PCT/EP2019/082279, dated Feb. 3, 2020, 12 pages.

(Continued)

*Primary Examiner* — Anthony R Jimenez
(74) *Attorney, Agent, or Firm* — Sage Patent Group

(57) ABSTRACT

A spring unit includes a mechanical spring means having a spring direction and being located between a first spring support and a second spring support, which first and second spring supports are movable in relation to each other in the spring direction. The spring unit further includes a first actuation member facing the rear side of the first spring support and a second actuation member facing the rear side of the second spring support, which first and second actuating members are movable relative to each other and relative to the first and second spring supports in the spring direction.

20 Claims, 3 Drawing Sheets

(58) Field of Classification Search
CPC ..... H01H 21/36; H01H 21/12; H01H 21/40; H01H 21/42; H01H 2235/00; H01H 2235/01; H01H 2001/223; H01H 2003/00; H01H 2003/008; H01H 2003/02; H01H 2003/32; H01H 2003/46; H01H 9/00; H01H 9/0016; H01H 9/0027; H01H 3/00; H01H 3/02; H01H 3/30; H01H 3/32; H01H 3/38; H01H 3/46; H01F 21/00; H01F 21/36; H01F 21/12; H01F 21/40; H01F 21/42; H01F 29/00; H01F 29/06; H01F 29/08; H01F 29/04
USPC ..... 336/137
See application file for complete search history.

(56) References Cited

U.S. PATENT DOCUMENTS

| | | | |
|---|---|---|---|
| 5,512,869 | A | 4/1996 | Thuries |
| 6,841,744 | B1 | 1/2005 | Kodo et al. |
| 9,607,781 | B2 | 3/2017 | Albrecht et al. |

FOREIGN PATENT DOCUMENTS

| | | | |
|---|---|---|---|
| DE | 4326127 | C1 | 11/1994 |
| EP | 0116748 | A1 | 8/1984 |
| EP | 2535910 | A1 | 12/2012 |
| EP | 3128531 | A1 | 2/2017 |
| FR | 2714522 | B1 | 6/1995 |
| JP | H09246068 | A | 9/1997 |
| KR | 20130136997 | A | 12/2013 |
| WO | 2012171773 | A1 | 12/2012 |

OTHER PUBLICATIONS

Extended European Search Report dated Oct. 10, 2019 for European Patent Application No. 19170682.9, 5 pages.
Korean Decision for Grant of Patent dated Oct. 27, 2021 for Korean Patent Application No. 10-2021-7017720, 3 pages (including English translation).
Chinese First Office Action dated Nov. 1, 2021 for Chinese Patent Application No. 201980088248.9, 8 pages (including English summary).
Indian Examination Report dated Mar. 21, 2022 for Indian Patent Application No. 2012147047914, 5 pages.

* cited by examiner

SPRING UNIT AND A DIVERTER SWITCH

CROSS REFERENCE TO RELATED APPLICATIONS

This application is a 35 U.S.C. § 371 national stage application of PCT International Application No. PCT/EP2019/082279 filed on Nov. 22, 2019, which in turns claims foreign priority to European Patent Application No. 19170682.9, filed on Apr. 23, 2019, the disclosures and content of which are incorporated by reference herein in their entirety.

FIELD

The present disclosure relates to a spring unit of the kind including mechanical spring means having a spring direction and being located between a first spring support and a second spring support, the first spring support having a front side abutting a first end of the spring means and a rear side opposite the front side, the second spring support having a front side abutting a second end of the spring means and a rear side opposite the front side, which first and second spring supports are movable in relation to each other in the spring direction, the spring unit further comprising a first actuation member facing the rear side of the first spring support and a second actuation member facing the rear side of the second spring support, which first and second actuating members are movable relative to each other and relative to the first and second spring supports in the spring direction.

The disclosure also relates to a diverter switch, a tap changer and a transformer.

BACKGROUND

A spring unit of the described type are commonly used in diverter switches for a tap changer in a transformer. Representative examples of such spring units are disclosed e.g. in U.S. Pat. Nos. 3,811,022, 6,841,744 and WO 2012171773.

A spring unit may be intended for actuating a diverter switch in a tap changer. A tap changer operates in connection with a transformer in order to vary the transformation rate thereof. In a transformer with a tap changer one of the windings in the transformer has a fixed amount of turns connected to the circuit. The other winding has one fixed connection point, whereas the other connection point can be selected among a number of points to attain a required voltage. The selectable points may be located after each other along a portion of the winding.

Upon a change in the load connected to the transformer or due to other influences it might be required to change the connection point. The need of changing the tap point is often triggered automatically in response to sensed parameters. Tap changing comprises a plurality of manoeuvres including opening and closing of switches in a diverter switch and moving a selector arm to a new connection point. These manoeuvres have to be performed in a certain sequence and in a certain time relation.

Opening and closing of the switches are to be performed rapidly and are therefore usually performed through a spring loaded energy accumulator and may include a mechanical spring unit. Upon opening or closing, the spring unit rapidly releases its energy to provide the actuation, and reaches a neutral state. Thereafter the spring unit is re-loaded in order to be prepared for the subsequent actuation.

It is desirable to reduce the volume of a tap changer. To a large extent the volume of the tap changer is depending on the volume of its diverter switch. By keeping the diverter switch within a small physical volume, the conditions to be able to do a compact tap changer get better. The physical volume of the diverter switch is dependent on the size of the spring units employed for actuating the switching.

In the sequence of operations in the diverter switch the actuation members defining a respective axis of the respective operations will alternately move rapidly towards each other or away from each other. The movement away from each other is effectuated in that the spring from a loaded stage when it is compressed expands to a neutral, released stage while pushing one of the actuation members.

When the actuation units are to be moved towards each other, the spring from a loaded stage when it is expanded contracts to a neutral, released stage while pulling one of the actuation units.

As mentioned above each switching operation is followed by recharging the spring, which in the first case means that the spring is compressed from its neutral stage, and in the second case means that the spring is expanded from its neutral stage.

With the operations described above, which are typical for a conventional spring unit in a diverter switch, the volume of the spring unit thus will be determined by the space required to house the spring when it is at an expanded stage in relation to the neutral stage. This leads to a somewhat bulky spring unit, which will cause a problem when striving to reach a tap changer with a volume that is as small as possible

SUMMARY

The object of some embodiments is to solve the above problem and more precisely to obtain a spring unit that have smaller dimensions than those of a spring unit conventionally used in diverter switches.

This object is achieved in that a spring unit of the kind specified in the preamble of claim 1 includes the specific features specified in the characterizing portion of the claim. The spring unit thus is such that the first actuation member is arranged to be able to apply a pushing force to the first spring support and includes first pulling means arranged to be able to apply a pulling force to the second spring support, and the second actuation member is arranged to be able to apply a pushing force to the second spring support and includes a second pulling means arranged to be able to apply a pulling force to the first spring support, such that a relative movement of the first and second actuation members towards each other results in compression of the spring means, and a relative movement of the first and second actuation members away from each other results in compression of the spring means.

Since not only the movement when the actuation members move towards each other but also when they move away from each other are achieved by expansion of the compressed spring, the spring never has to be at an expanded stage. This reduces the space requirement of the spring unit and thereby makes it possible to obtain a less bulky tap changer.

According to an embodiment of the spring unit, at least the first pulling means includes at least one rod extending in the spring direction and having a carrier means arranged to cooperate with the second spring support.

This is a mechanical convenient solution for applying the pulling force to the second spring support. It results in a simple and reliable function.

According to a further embodiment, the at least one rod extends through a respective through hole in the second spring support.

By arranging the rod such that it extends through the remote spring support it will be particularly simple to obtain the pulling force. Preferably, but not necessarily, the rod has a circular cross section. Preferably, but not necessarily the cross section of the hole corresponds to that of the rod.

According to a further embodiment, each rod is provided with a radial extension extending radially outside the related through hole, which extension forms the carrier.

Since the radial extension reaches outside the hole it will in a simple way perform the task as a carrier able to act on the spring support during the pulling movement. The term radial does not necessarily imply that the rod is circular but merely means an extension in a plane perpendicular to the longitudinal direction of the rod.

According to a further embodiment, the at least one rod is provided with a circumferential groove housing a ring device establishing the extension.

This provides a simple assembly of the spring unit. The rod can without obstacle be pushed through the hole, and then the ring device can be snapped into the groove. Preferably the ring device has a slit to allow an easy snapping thereof into the groove.

According to a further embodiment, the at least one rod extends through a respective through hole in the first spring support.

This further contributes to a simple construction of the spring unit. Also this through hole preferably has a shape that corresponds to the shape of the rod. Preferably the hole dimension is such that it adapts to the rod with enough play for avoiding to much friction but tight enough to provide guidance and stability.

According to a further embodiment, also the second pulling means includes at least one rod extending in the spring direction and has a carrier means arranged to cooperate with the first spring support.

Such symmetrical design further contributes to a simple, reliable and compact unit.

According to a further embodiment, the second pulling means includes features corresponding to those of the first pulling means according to the embodiments mentioned near above.

According to a further embodiment, the number of rods of each pulling means is two.

With two rods forming the pulling means there will be possible to obtain an advantageous force balancing in comparison with using only one rod for each pulling means. More rods than two makes the construction unnecessarily complicated. The two rods may be located on opposite sides of the spring means in order to enhance the balance of forces.

According to a further embodiment, the axes of the four rods are located in a respective corner of a rectangle, and the rods of the first pulling means and the second pulling means are diagonally located, respectively, in the rectangle.

The complete pattern of forces for the two pulling means thereby will be enhanced with outbalanced forces and the construction will be symmetric. This further contributes to simplicity and reliability.

According to a further embodiment, the spring means consists of one single helical spring.

Although the general concept of the disclosure is applicable also when the spring means includes a plurality of springs and/or springs of various configurations, the use of a single helical spring contributes to obtain a spring unit that is compact and simple.

According to a further embodiment, the spring unit is adapted to actuate a contact of a diverter switch.

The advantages of a spring unit according to some embodiments are of particular interest in the application of a diverter switch.

Some embodiments relate to a diverter switch including at least on spring unit. Further, some embodiments relate to a tap changer including the diverter switch and to a transformer including the tap changer.

The diverter switch, tap changer and transformer have similar advantages as those of the spring unit and the embodiments thereof, respectively, and which advantages have been described above.

Some embodiments are set out in the dependent claims. Further embodiments may be constituted by any possible combination of features in the described embodiments and by any possible combination of these features with features mentioned in the description of an example below.

DESCRIPTION OF EXAMPLE

Figure 1:
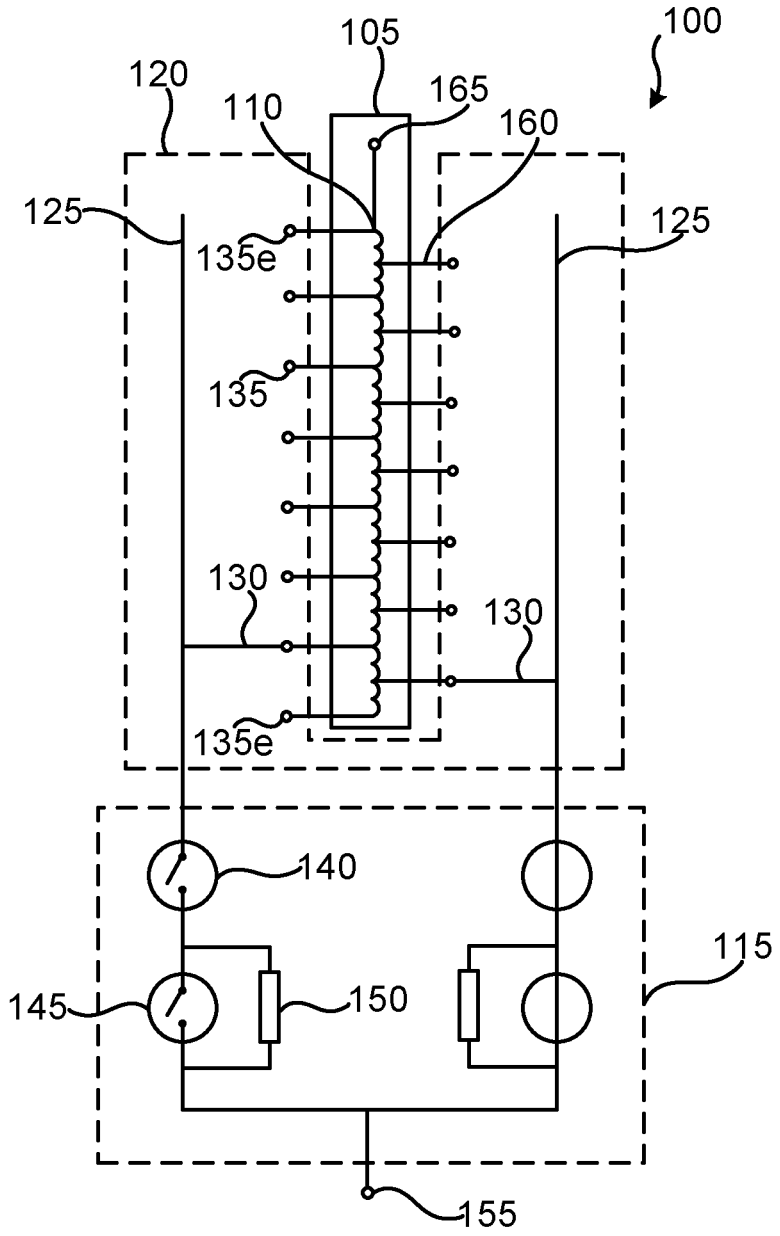
FIG. 1 is schematic illustration of a tap changer of a kind for which the spring unit according to some embodiments is suitable.

In order to illustrate the context of some embodiments, FIG. 1 schematically illustrates a tap changer 100 of a kind for which the spring unit is intended. The tap changer 100 is connected to a regulating winding 105 of a transformer and has a set of different taps 110. The tap changer of FIG. 1 is of diverter switch type, and comprises a diverter switch 115 and a tap selector 120.

The tap selector 120 of FIG. 1 comprises two current collectors 125, two selector arms forming two movable contacts 130 and further comprises a set of fixed contacts 135, where each fixed contact 135 is arranged to be connected to one of the taps 110 of the regulating winding. The illustrated tap changer has fifteen different fixed contacts 135, and the regulating winding has fifteen taps. The tap changer of FIG. 1 is mechanically linear in the sense that the current collectors 125 are implemented as linear rods, and the fixed contacts are implemented in a linear fashion. The two current collectors 125 together form a current collector part.

The diverter switch 115 comprises two series connections of a main contact 140 and a transition contact 145, with transition resistor 150 connected in parallel with transition contact 145. It is common that the contacts are vacuum interrupters. Each of the series connectors are, at one end connected to a respective one of the two current collectors 125, and at the other end connected to an external contact 155 of the tap changer 100.

The movable contacts 130 are at one end in electrical contact with a respective one of the current collectors 125. A selector arm 130 can move along the current collector 125 to which it is connected, in order to reach different positions, at which the other end of the movable contact 130 is in electrical contact with one of the fixed contacts. The movable contacts 130 could for example be sliding contacts arranged to slide along the current collectors 125 and the different fixed contacts 135. The driving of the movable contacts 130 is arranged so that if one of the movable contacts 130 is in contact with a fixed contact 135, connected to a first tap, the other moveable contact 130 is in contact with a fixed contact 135, connected to a tap 110 which is adjacent to the first tap 110.

By switching the main contacts 140 and transition contacts 145 in a conventional manner, one or the other of the moveable contacts 130 will be in electrical contact with the external contact 155, and thus provide an electrical path through the tap changer 100. Similarly, the two current collectors 125 will take turns at being part of the electrical path of the tap changer 100. The electrical path through the tap changer 100 ends at the external contact 155 at one end, and at the fixed contact 135 that is currently connected at the other end. An example of a diverter switch is described in EP 0116748. The diverter switch 115 is an example only, and any suitable type of diverter switch can be used.

As mentioned above, the regulating winding 105 has a set of taps 110, which are shown to be connected to the fixed contacts 1355 of the tap changer 100 via cables 160. The other end of the regulating winding 105 is provided with an external contact 165. Depending on which tap 110 is currently connected to a fixed contact 135, the electrical path between the external contacts 155 and 165 will include a different number of the regulating winding turns.

When it is required to change from one tap to another, the vacuum interrupters of the contacts 140 and 145 and those on the other current collector are to be closed and opened, respectively in a certain sequence. This allows the selector arms with the movable contacts 130 to move to come into contact with the adjacent one of the fixed contacts 135. Closing and opening of the vacuum interrupters in the diverter switch 115 and movement of the movable contacts in the tap selector 170 has to be made in a certain time relation to each other. The actuation of the vacuum interrupters requires a rapid and strong actuation force, that normally is obtained by an energy accumulator having a spring that can be charged and rapidly discharged.

The spring according to some embodiments has the function to provide such energy accumulators for effectuating the actuation of the interrupters in the diverter switch.

Figure 2:
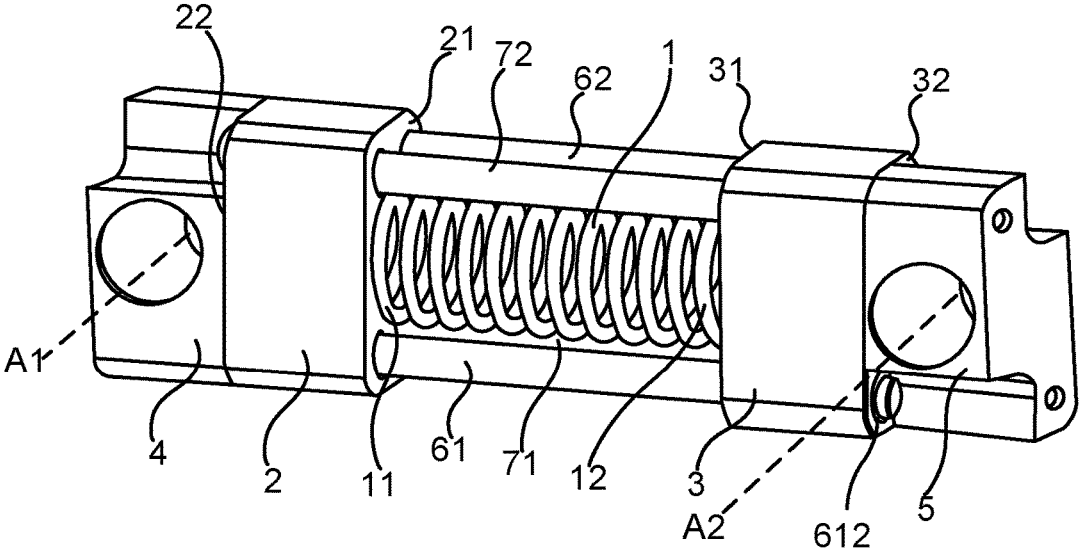
FIG. 2 is a perspective view of a spring unit according to some embodiments in a neutral stage.
Figure 3:
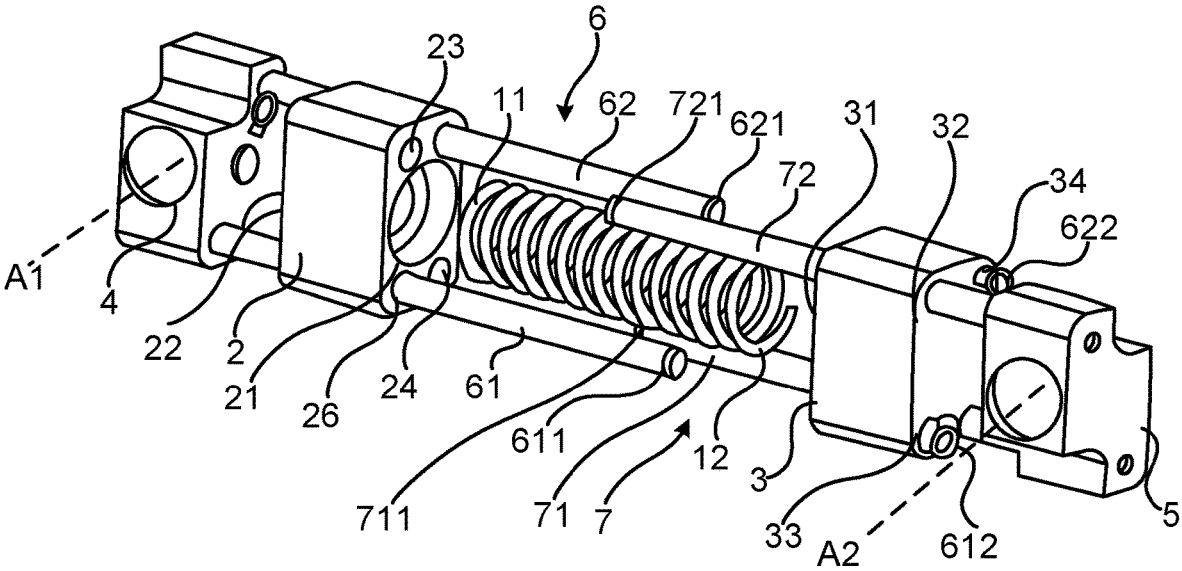
FIG. 3 is a split view of the spring unit in FIG. 2.

FIGS. 2 and 3 in a perspective view and in a perspective split view, respectively, illustrate an example of a spring unit according to some embodiments. The spring unit has a helical compression spring 1. A first end 11 of the spring 1 abuts the front side 21 of a first spring support 2 at the left side of the figures. A second end 12 of the spring 1 correspondingly abuts the front side 31 of a second spring support 3.

Axially outside the first spring support 2 a first actuation member 4 is located, and defines a first actuation axis A1 of the diverter switch. Similarly a second actuation member 5 is located axially outside the second spring support 3 and defines a second actuation axis A2 of the diverter switch.

The first actuation member 4 has two rods 61, 62 rigidly connected to the actuation member 4 and extending in parallel to the axis of the spring 1. Each of the rods 61, 62 extend through holes 25, 26, respectively, in the first (the adjacent) spring support 2 and through holes 33, 34, respectively, in the second (the remote) spring support 3.

As can be seen in FIG. 3 each rod 61, 62 adjacent its end is provided with a circumferential groove 611, 621. In each groove a silted ring 612, 622, respectively, is mounted by having been snapped into the groove 611, 621. Each ring 612, 622 extends radially outside the related groove and has a larger outer diameter than the holes 25, 26, 33, 34

The diameter of the through holes 25, 26, 33, 34 corresponds to the diameter of the rods 61, 62, such that the rods 61, 62 with sufficient play can move axially through the holes 25, 26, 33, 34. Each ring 612, 622 extends radially outside the respective holes 25, 26, 33, 34.

The two rods 61, 62 together with their rings 612, 622 constitute pulling means, through which the second spring support 3 (on the right side of the figures) can be pulled in the leftward direction when the first actuation member (on the left side of the figures) is moving leftwards. The rings 612, 622 thereby act as a carrier when they abut the rear side 32 of the second spring support 3.

The second actuation member 5 (at the right side of the figures) correspondingly has two rods 71, 72 with grooves, rings and function that are equal to what have been described above for the rods 61, 62, but act in the opposite direction.

Figure 4:
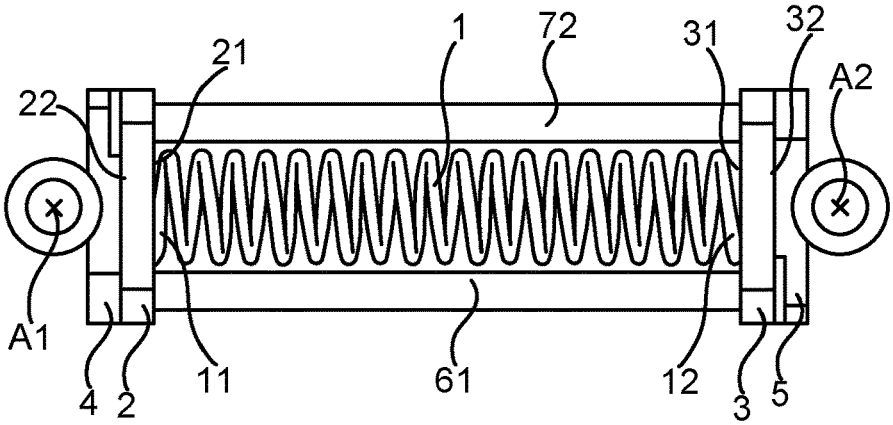
FIG. 4 is a schematic side view of the spring unit in FIG. 2 in a neutral stage.
Figure 5:
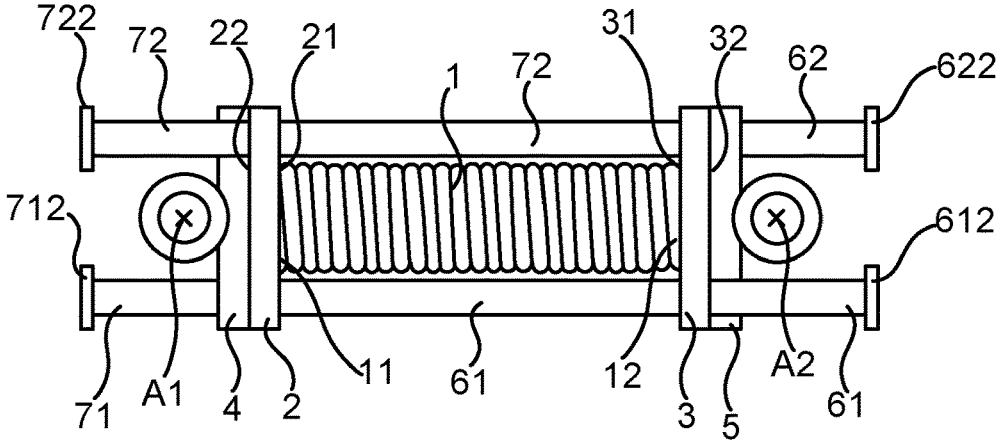
FIG. 5 is a schematic side view of the spring unit of FIG. 2 in a compressed stage, where compression has been attained by pushing.
Figure 6:
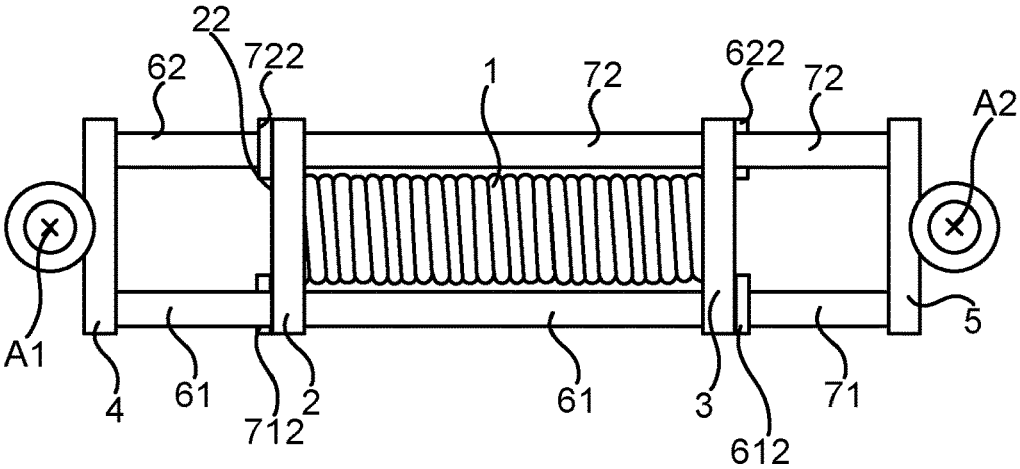
FIG. 6 is a schematic side view of the spring unit of FIG. 2 in a compressed stage, where compression has been attained by pulling.

FIG. 4 in a schematic side view illustrates the spring unit in its neutral stage when the spring 1 neither is compressed nor expanded. FIGS. 5 and 6 illustrate the spring unit when loaded, in both cases by being compressed, but through two different modes of operation.

FIG. 5 illustrates compression of the spring when the two actuation axes A1, A2 move towards each other, normally in that one is moving towards the other which is stationary. When axis A2 moves from the neutral position in FIG. 3 in the leftward direction and axis A1 is stationary, the second actuation member 5, related to axis A2, pushes on the rear side 32 of the second spring support 3. The front side 31 of the second spring support abuts the second end 12 of the spring 1 and thus moves the second end 12 of the spring to the left. The first end 11 of the spring 1 abuts the front side 21 of the first spring support 2 and since the first spring support 2 with its rear side 22 contacts the stationary first actuation member 4, the spring 1 becomes compressed until it reaches the state illustrated in FIG. 5.

During this compression movement the rods 71 and 72 extending through the related holes in the second spring support 3 will move to the left and thereby move through the related holes 24, 23 in the first spring support 2 and project out on the left side of the first spring support 2 until it reaches the position in FIG. 5. The rods 71 and 72 are laterally located outside the first actuation member 4 (as visualized in the left end of FIG. 3), and therefore freely passes the first actuation member 4. As the second actuation member 5 together with the second spring support 3 moves to the left, the stationary rods 61, 62 of the first actuation member 4 will in a corresponding way pass through the holes in the second spring support 3 and laterally outside the second actuation member 5 to reach the position in FIG. 5. The spring unit is now loaded and prepared for the next switching manoeuvre. This mode of compression principally corresponds to conventional technique.

FIG. 6 illustrates compression of the spring when the two actuation axes A1, A2 move away from each other, in that the first axis A1 is stationary and the second axis A2 moves to the right from the position in FIG. 4. Thereby the rods 71 and 72 move to the right through the related holes in the second spring support 3, which in this position is locked against movement to the right. When the rods 71, 72 move to the right, their respective ring 712, 722 act on the rear side 22 of the first spring support 2 such that the first spring support is pulled in the rightward direction. The second spring support 3 is prevented to move rightwards by the rings 612, 622 on the rods 61, 62 attached to the stationary first actuation member 4. The spring 1 therefore becomes compressed between the two spring supports 2, 3 until it reaches the position of FIG. 6.

According to conventional technique the spring is loaded by expansion when the actuation axes move away from each other, which requires more space in the axial direction and renders the spring unit to be more bulky.

The invention claimed is:

1. A spring unit including mechanical spring means having a spring direction and being located between a first spring support and a second spring support, the first spring support having a front side abutting a first end of the spring means and a rear side opposite the front side, the second spring support having a front side abutting a second end of the spring means and a rear side opposite the front side, wherein the first and second spring supports are movable in relation to each other in the spring direction, the spring unit further comprising a first actuation member facing the rear side of the first spring support and a second actuation member facing the rear side of the second spring support, wherein the first and second actuation members are movable relative to each other and relative to the first and second spring supports in the spring direction, wherein the first actuation member is arranged for applying a pushing force to the first spring support and includes first pulling means arranged apply for applying a pulling force to the second spring support, and the second actuation member is arranged for applying a pushing force to the second spring support and includes a second pulling means arranged for applying a pulling force to the first spring support, wherein a movement of the first and second actuation members towards each other results in compression of the spring means, and a movement of the first and second actuation members away from each other results in compression of the spring means.

2. A spring unit according to claim 1, wherein the spring unit is configured to actuate a contact of a diverter switch.

3. A spring unit according to claim 1, wherein the spring means consists of one single helical spring.

4. A spring unit according to claim 1, wherein at least the first pulling means includes at least one rod extending in the spring direction and having a carrier means arranged to abut the second spring support.

5. A spring unit according to claim 4, wherein the at least one rod extends through a respective through hole in the first spring support.

6. A spring unit according to claim 4, wherein also the second pulling means includes at least one rod extending in the spring direction and having a carrier means arranged to abut the first spring support.

7. A spring unit according to claim 4, wherein the at least one rod extends through a respective through hole in the second spring support.

8. A spring unit according to claim 4, wherein the number of rods of each pulling means is two.

9. A spring unit according to claim 8, wherein the axes of the four rods are located in a respective corner of a rectangle, and wherein the rods of the first pulling means are diagonally located in the rectangle, and the rods of the second pulling means are diagonally located in the rectangle.

10. A spring unit according to claim 6, wherein the second pulling means includes features associated with those of the first pulling means specified in claim 7.

11. A spring unit according to claim 7, wherein the at least one rod extends through a respective through hole in the first spring support.

12. A spring unit according to claim 7, wherein the number of rods of each pulling means is two.

13. A spring unit according to claim 7, wherein each rod is provided with a radial extension extending radially outside said through hole in the second spring support, wherein the extension forms said carrier means.

14. A spring unit according to claim 13, wherein the number of rods of each pulling means is two.

15. A spring unit according to claim 13, wherein the at least one rod extends through a respective through hole in the first spring support.

16. A spring unit according to claim 13, wherein the at least one rod is provided with a circumferential groove housing a ring device establishing said extension.

17. A spring unit according to claim 16, wherein the at least one rod extends through a respective through hole in the first spring support.

18. A diverter switch, comprising:

a contact; and a spring unit that is configured to actuate the contact;

wherein the spring unit includes mechanical spring means having a spring direction and being located between a first spring support and a second spring support, the first spring support having a front side abutting a first end of the spring means and a rear side opposite the front side, the second spring support having a front side abutting a second end of the spring means and a rear side opposite the front side, wherein the first and second spring supports are movable in relation to each other in the spring direction, the spring unit further comprising a first actuation member facing the rear side of the first spring support and a second actuation member facing the rear side of the second spring support, wherein the first and second actuation members are movable relative to each other and relative to the first and second spring supports in the spring direction, wherein the first actuation member is arranged for applying a pushing force to the first spring support and includes first pulling means arranged for applying a pulling force to the second spring support, and the second actuation member is arranged for applying a pushing force to the second spring support and includes a second pulling means arranged for applying a pulling force to the first spring support, wherein a movement of the first and second actuation members towards each other results in compression of the spring means, and a movement of the first and second actuation members away from each other results in compression of the spring means.

19. A tap changer including a diverter switch according to claim 18.

20. A transformer, comprising:

a tap changer including a diverter switch;

wherein the diverter switch comprises:

a contact; and a spring unit that is configured to actuate the contact;

wherein the spring unit includes mechanical spring means having a spring direction and being located between a first spring support and a second spring support, the first spring support having a front side abutting a first end of the spring means and a rear side opposite the front side, the second spring support having a front side abutting a second end of the spring means and a rear side opposite the front side, wherein the first and second spring supports are movable in relation to each other in the spring direction, the spring unit further comprising a first actuation member facing the rear side of the first spring support and a second actuation member facing the rear side of the second spring support, wherein the first and second actuation members are movable relative to each other and relative to the first and second spring supports in the spring direction, wherein the first actuation member is arranged for applying a pushing force to the first spring support and includes first pulling means arranged for applying a pulling force to the second spring support, and the second actuation member is arranged for applying a pushing force to the second spring support and includes a second pulling means arranged for applying a pulling force to the first spring support, wherein a movement of the first and second actuation members towards each other results in compression of the spring means, and a movement of the first and second actuation members away from each other results in compression of the spring means.

* * * * *